United States Patent [19]

Okamoto et al.

[11] Patent Number: 4,970,552

[45] Date of Patent: Nov. 13, 1990

[54] TONER CONTAMINATION PREVENTIVE MEANS

[75] Inventors: Keiji Okamoto; Hiromi Takada; Hideo Aoki, all of Yokohama; Toshio Shimazaki, Tokyo, all of Japan

[73] Assignee: Ricoh Company, Ltd., Tokyo, Japan

[21] Appl. No.: 196,493

[22] Filed: May 20, 1988

[30] Foreign Application Priority Data

May 29, 1987 [JP] Japan ..... 62-135409
May 29, 1987 [JP] Japan ..... 62-135410

[51] Int. Cl.[5] ..... G03G 21/00

[52] U.S. Cl. ..... 355/215; 355/1; 355/30

[58] Field of Search ..... 355/215, 1; 350/582, 350/584

[56] References Cited

U.S. PATENT DOCUMENTS 4,469,430 9/1984 Terashima ..... 355/215 X

FOREIGN PATENT DOCUMENTS

| | | | |
|---|---|---|---|
| 53-5631 | 1/1978 | Japan | 355/215 |
| 56-27170 | 3/1981 | Japan | 355/215 |
| 56-133747 | 10/1981 | Japan | 355/215 |
| 59-29276 | 2/1984 | Japan | 355/215 |
| 60-21066 | 2/1985 | Japan | 355/215 |
| 60-52875 | 3/1985 | Japan | 355/215 |
| 62-75658 | 4/1987 | Japan | 355/215 |

*Primary Examiner*—A. T. Grimley
*Assistant Examiner*—Mathew S. Smith
*Attorney, Agent, or Firm*—Oblon, Spivak, McClelland, Maier & Neustadt

[57] ABSTRACT

An electrostatic photographic image forming apparatus for forming an electrostatic image on a photosensitive member by the light beam from a writing system and transferring to a transfer paper the image which has been made visible by a development apparatus. A shutter or a toner contamination preventive means is provided at the space defining an optical path extending between the photosensitive member and the lens of the writing system nearest to the photosensitive member.

2 Claims, 3 Drawing Sheets

TONER CONTAMINATION PREVENTIVE MEANS

FIELD OF THE INVENTION AND RELATED ART STATEMENT

The present invention relates to an image forming apparatus based on an electrophotographic process.

Image forming apparatuses based on electrophotographic process such as copying machines, laser printers and the like are widely known. In the image forming apparatuses according to prior arts, the writing system is disposed over the photosensitive member and the writing light for forming an electrostatic latent image is quite frequently illuminated from above onto the photosensitive member. In this case, it seldom happened that the lens of the writing system was contaminated by the toner scattered from the development apparatus. However since the transfer paper is directed under the photosensitive member, and various apparatuses including a photosensitive member, writing system and the like are disposed over the guide path for the transfer paper once the transfer paper is jammed, it is cumbersome and time-consuming work to remove the jammed paper.

In order to make it easy to remove the jammed paper, the guide path for the transfer paper should preferably be located at as high a position as position in the image forming apparatus. For this purpose, however the writing system should be disposed below the photosensitive member or a image carrier. This manner of arrangement makes it easy to deliver the paper facing downwardly particularly in a printer and satisfy the desire of users.

It has to be noted however that since the writing system is located below the photosensitive members or the image carrier, the scattered toner may reach the lens through the writing light path to cause the lens to be contaminated. Contamination of the lens is problematical for it will directly result in a dirty image.

OBJECT AND SUMMARY OF THE INVENTION

The object of the present invention is to eliminate the problems as above explained due to prior arts and to provide an image forming apparatus which will not cause the lens to be contaminated by the toner.

In order to attain the above-mentioned object, the present invention is characterized in that a shutter capable of shielding the space defining the optical path between the photosensitive member and the lens of the writing system nearest to the photosensitive member is provided.

The present invention has attained the above-mentioned object by providing a toner contamination preventive means adapted to prevent the lens disposed in the optical path of the writing system from being contaminated by the toner.

The toner contamination preventive means may be constituted as an adhesive member to be applied to at least a part of the wall of the optical path extending from said image carrier to said lens.

The toner contamination preventive means may also be constituted as the toner receptacle provided at the wall of the optical path extending from image carrier to the lens.

The toner contamination preventive means may be further constituted as the magnetic member provided along at least a part of the wall of the optical path extending from the image carrier to the lens or the magnetic member adhered to at least a part of the wall of the optical path.

Furthermore the toner deterioration preventive means may be constituted as the step-back defined by the lower plate of the optical path forming plates and the upper plate of the optical path forming plate which is more projecting than the lower plate at the end of the optical path at the side of the image carrier, the lower and upper plates forming the optical path extending from the image carrier to the lens.

The present invention thus serves to positively protect the lenses disposed adjacent to the photosensitive member such as a cylindrical lens, a toroidal lens and the like from adherence of the scattered toner and reduce distorsion of the images due to contamination of lenses.

The present invention will now be explained in detail with respect to an embodiment by referring to the accompanying drawings.

DETAILED DESCRIPTION OF PREFERRED EMBODIMENTS

Figure 1:
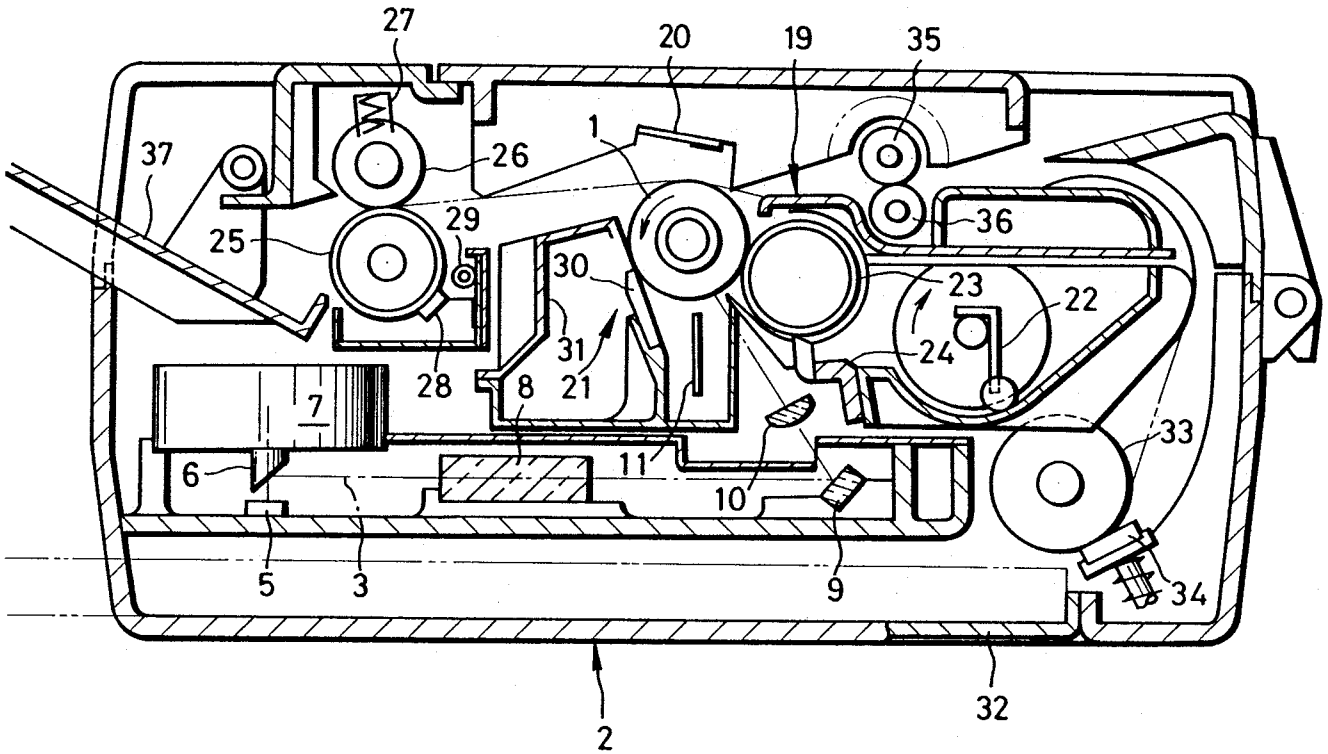
FIG. 1 is the sectional view showing the image forming apparatus according to the present invention.

FIG. 1 illustrates a laser printer as an example of the image forming apparatus according to the present invention.

In FIG. 1, the writing system 2 is disposed below the image carrier or the photosensitive member 1.

Figure 2:
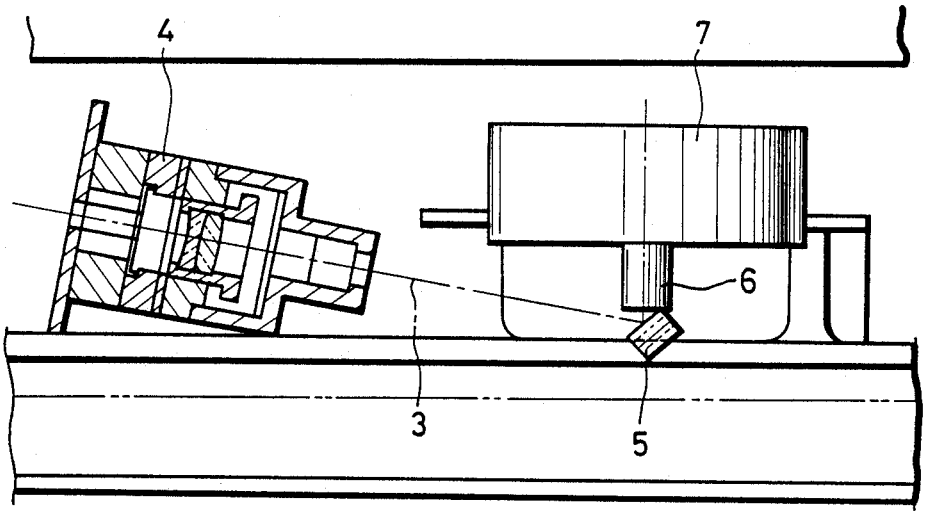
FIG. 2 is the explanatory drawing for a part of the writing system.

The writing system 2 comprises as shown in FIG. 1 and FIG. 2 the laser unit 4 adapted to provide a laser beam 3 in response to the image information signals, the first mirror 5 adapted to reflect the laser beam coming from said laser unit 4, the deflecting mirror 6 adapted for incidence of the beam reflected from the first mirror 5 and the scanner motor 7. The deflecting mirror 6 is mounted on the output shaft of the scanner motor 7.

The laser unit 4 is consisted of a laser diode, the driving board for the laser diode, a collimate lens, and an aperture. The laser diode has an oscillating wavelength of about 780±10 nm as an example and an output of about 3 mW.

The laser diode is caused to emit the light in response to the control signals provided by the engine drive board. The power for the laser diode to emit light is fed back to the engine drive board so that the reference value for light emitting power may be kept constant.

The collimate lens serves to convert the diffused light generated by the laser diode as the source of illumination into the parallel light beam. The size of the beam is regulated by the aperture.

The deflecting mirror 6 is driven by the scanner motor 7 to rotate at a high speed and adapted to scan the laser beam irradiated by the laser unit around 360 degrees.

The laser beam thus scanned is then detected by a synchronous detecting sensor so that the timing for initiation of illumination of the laser beam for image forming may be controlled.

The angle of scanning for the laser beam for image forming is about 104 degree in which period light emission is controlled for each dot.

The laser been which has been scanned by the deflecting mirror 6 is so adjusted by the fθ lens 8 that any curvature of the image in the main scanning direction and the sub scanning direction and speed difference in each scanning on the surface of the photosensitive member or the photosensitive drum 1 may be corrected.

The laser beam thus corrected by fθ lens 8 is reflected by the second mirror 9 to scan the outer surface of the photosensitive drum 1 through the cylindrical lens 10.

The cylindrical lens 10 is adapted to correct the angle of laser beam due to mounting tolerances of the motor 7 as well as of the respective mirrors.

When the laser beam is irradiated on the photosensitive drum or the opc drum 1, the surface potential of the drum charged in (−) will be attenuated, so that an electrostatic latent image corresponding to the image signal will be formed.

Around the photosensitive member 1 there are arranged in a manner well known a charger 11, a developing apparatus 19, a transfer charged 20 and a cleaning apparatus 21.

The outer surface of the photosensitive drum 1 is charged to (−) 800 V or less by discharge of the charger.

The toner contained in the developing apparatus 19 is fed to the vicinity of the developing roller 23 by means of the agitator 22. The toner attached to the surface of the developing roller 23 either magnetically or electrostatically is made to a thin layer having a suitable thickness by the doctor blade 24 and transferred to the position to be in contact with the photosensitive drum (opc drum) 1.

As the toner deposited on the surface of the developing roller 23 will be adhered to the electrostatic latent image on the photosensitive drum 1, the latent image will become a visible image.

It is to be noted that if the development process of positive-to-positive is employed, the toner will be deposited on the portion of the photosensitive drum 1 other than the exposure area (or low potential area) while if the development process of negative-to-positive is employed, the toner will be deposited on the exposure area.

A transfer paper is superimposed on the surface of the photosensitive drum 1 where a visible image has been formed by the toner, the reverse side of the transfer paper is corona discharged by the transfer charger 20 and provided with charge having opposite polarity to that of the charge of the toner and the toner will then be transferred to the transfer paper by the electrostatic power.

Since the toner image on the transfer paper is unstable, the paper will then be passed through the nip between the heating roller 25 and the pressure roller 26 urged against the heating roller 25 by a spring 27, so that the toner image on the transfer paper will be thermally fixed.

The surface temperature of the heating roller 25 is kept at a level of about 160°-175° C. by means of a thermister 28 and a temperature fuse 29 is also provided for safety.

After the transfer operation as above explained is over, the photosensitive member is scraped by the blade 30 of the cleaning apparatus off the toner which has not been transferred and remain deposited on the surface of the photosensitive member and thus cleaned. The toner thus scraped off will be recovered in the waste toner container 31.

The transfer paper is fed by the feed roller 33 out of the supply casette 32. The feed roller is turned on and off by the clutch not shown and pressed against the transfer paper.

In order to avoid dual supply of the transfer paper, the friction pad 34 is urged against the feed roller 33 so that the second sheet of the transfer paper is inhibited from being advanced by the friction provided by the friction pad until the uppermost paper has been fed out.

The transfer paper which has been supplied by the feed roller 33 is detected by the register sensor and supplied to the register roller 35 where it is stopped. The detection signal provided by the register sensor causes the feed clutch to turn off to stop the feed roller 33.

When the register clutch is operated by control provided from the control board, then the transfer paper is advanced by the register roller 35 and the guide roller 36 to be transferred with the toner image and fixed.

After the fixing process, the transfer paper will be stacked in the tray 37. It is also possible to manually feed the transfer paper in the direction shown by the arrow A.

Figure 3:
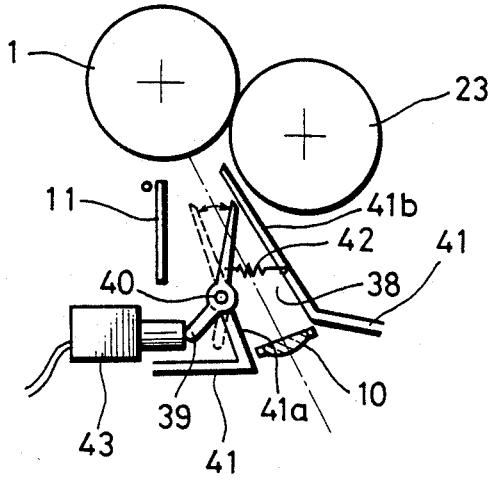
FIG. 3 illustrates the vital portion of the part of the inventive apparatus relating to the writing system adjacent to the drum.

Below the photosensitive member 1, there is defined a passage extending through the cylindrical lens 10 for the laser beam to be passed through for irradiation. Eventually this passage for beam will cause the toner to be dispersed onto the cylindrical lens 10. In order to avoid this dispersion of the toner as shown in FIG. 3, a shutter 39 adapted to shield the space 38 at the location between the photosensitive member 1 and the lens 10 is rotatably attached to the frame 41 of the apparatus by means of the supporting pin 40, the space 38 provided the optical path forming plates 41*a*, 41*b* forming a part of the frame of the apparatus and defining the passage for beam extending from the cylindrical lens toward the photosensitive member 1.

The shutter 39 is normally biased by the rotational power of the spring 42 in the direction of shielding the passage 38. It is therefore apparent that even if the toner may fall when the cover is opened to replace the toner supply or some vibration may be caused for certain reason, the toner will not reach the lens 10. Accordingly the lens 10 may be protected against contamination by the toner.

A solenoid 43 is coupled to the shutter 39. At the time of printing, the shutter 39 is rotated by the solenoid to the position designated by the dotted line, so that the passage of beam may be opened and the laser beam may be freely irradiated on the photosensitive member 1. When printing process is over, the solenoid 43 will be deenergized to close the sapce 38 again.

The means of opening and closing the shutter 39 is not limitted to a solenoid, but a cam mechanism may be employed to open and close the shutter. Any other appropriate mechanism may be utilized as well for this purpose.

The shutter may be so designed that it will be closed when the cover is opened. It is also possible to keep it closed normally and open it in response to the printing signal.

Figure 4:
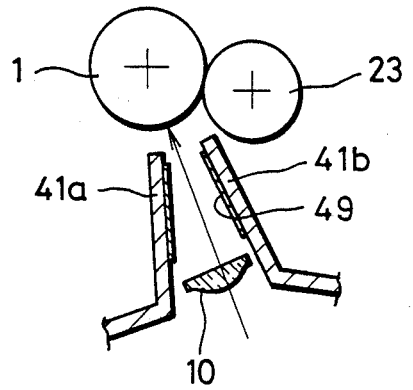
FIG. 4 through FIG. 6 are sectional views illustrating different embodiments of the toner contamination preventive means.

As shown in FIG. 4, the toner contamination preventive means constituted as an adhesive member 43 may be attached to the inner walls of the optical path forming plate 41*a* and 41*b* defining the passage for beam.

Being constituted as above explained, the toner which escape from the contact surface between opc drum 1 and the development roller 23 or fall directly from the development roller 23 may be captured before it reaches the lens 10. Consequently the lens 10 may be prevented from contamination.

In case that the toner as used in FIG. 4 is magnetic toner, similar effect to the one obtained by the above-mentioned embodiment may be attained if the toner contamination preventive means made of a magnetic member in place of the adhesive member 49 is attached to said plates.

Figure 5:
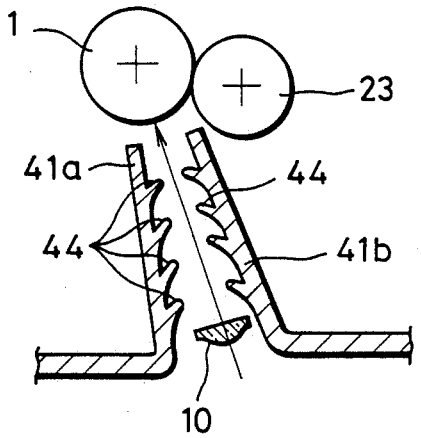

FIG. 5 illustrates a further embodiment of the present invention in which the toner contamination preventive means constituted as the toner receptacles 44 projecting obliquely toward the opc drum from the wall of the optical path forming plates 41*a*, 41*b* is provided.

Owing to this arrangement, the toner may be captured by the toner receptacles 44 before it reaches the lens 10.

Figure 6:
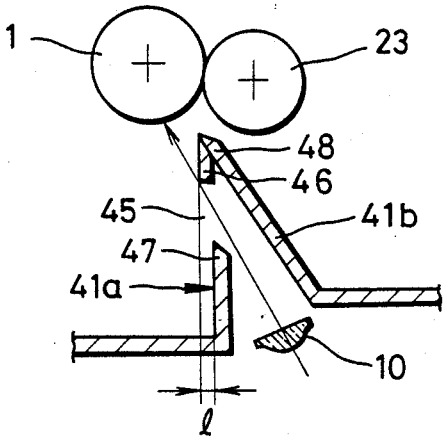

FIG. 6 illustrates still another embodiment in which the optical path forming plates 41*a* and 41*b* are disposed to form an inverted "V" and the plates are joined to each other at the tip end 48 in the vicinity of opc drum 1.

One of the optical path forming plates 41*a*, 41*b*, more specifically the plate 41*a* which is joined with the other plate obliquely and upwardly extending is provided with an opening 45 located below said tip end 48 for the beam to pass therethrough. It is to be noted that the portion 46 of the optical path forming plate 41*a* upwardly of said opening 45 is displaced outwardly by the distance 1 from the portion 47 downwardly of said opening, resulting in a step-back between the upper portion 46 and the lower portion 47. The upper portion 46 and lower portion 47 defining the step-back constitutes a toner contamination preventive means.

The toner which is scattered or dispersed will be distributed leftwardly or rightwardly at the tip end 48 and then fall down along the optical path forming plates 41*a*, 41*b*. The portion of the toner which falls along the plate 41*b* is already separated from the optical path which the portion of the toner which falls down along the plate 41*a* will fall along the upper portion 46 of the plate 41*a*. Since the lower portion 47 of the plate 41*a* is indented inwardly than the upper portion 46 to form a step-back, the toner will fall directly out of the optical path without entering the opening 45 so that ingress of the toner into the optical path may be prevented.

The present invention is capable of preventing the lenses from being contaminated by scattering of the toner by using the above-mentioned embodiments either individually or in combination.

What is claimed is:

1. An image forming apparatus comprising:

a photosensitive member;

a writing system for forming an electrostatic latent image on said photosensitive member by a light beam;

a development apparatus for developing said latent image;

a transfer charger for transferring a visual image on said photosensitive member to a transfer paper; and a toner contamination preventive means for preventing the contamination of a lens disposed in an optical path of the writing system, wherein said toner contamination preventive means includes an adhesive member attached to at least a part of a wall defining said optical path, and said optical path extends from said photosensitive member to said lens.

2. An image forming apparatus comprising:

a photosensitive member;

a writing system for forming an electrostatic latent image on said photosensitive member by a light beam;

a development apparatus for developing said latent image;

a transfer charger for transferring a visual image on said photosensitive member to a transfer paper;

plates disposed beneath said photosensitive member forming an acute angle and extending from said photosensitive member to a lens disposed in said writing system for defining an optical path of said writing system, an upper portion and a lower portion of one of said plates providing an opening for said optical path; and a toner contamination preventative means for preventing contamination of said lens including a step-back defined by said upper portion and said lower portion of said one of said plates, said upper portion projecting over said lower portion to partially cover said lower portion.

* * * * *